US007891061B2

(12) United States Patent
Lin

(10) Patent No.: US 7,891,061 B2
(45) Date of Patent: Feb. 22, 2011

(54) ZIPPER HEAD

(75) Inventor: Yu-Pau Lin, Pingjhen (TW)

(73) Assignee: Chung Chwan Enterprise Co., Ltd., Taoyuan Hsien (TW)

( * ) Notice: Subject to any disclaimer, the term of this patent is extended or adjusted under 35 U.S.C. 154(b) by 619 days.

(21) Appl. No.: 11/976,342

(22) Filed: Oct. 24, 2007

(65) Prior Publication Data

US 2009/0106952 A1 Apr. 30, 2009

(51) Int. Cl.
*A44B 19/30* (2006.01)
*A44B 19/26* (2006.01)

(52) U.S. Cl. ..... 24/424; 24/429

(58) Field of Classification Search ..... None
See application file for complete search history.

(56) References Cited

U.S. PATENT DOCUMENTS 4,287,646 A * 9/1981 Kanzaka ..... 24/424

FOREIGN PATENT DOCUMENTS

TW M292296 6/2006

* cited by examiner

*Primary Examiner*—Jack W. Lavinder
(74) *Attorney, Agent, or Firm*—Rosenberg, Klein & Lee

(57) ABSTRACT

A zipper head includes a puller, a horse hook, an elastic piece, a cap and a pulling piece. The puller has guiding grooves there inside and an accommodating portion and a penetrating hole on top thereof. The end portion is disposed under the horse hook. One end of the elastic piece is fixed on the puller. Both sides in the interior of the cap are provided with a protrusion respectively. The two protrusions of the cap are located above the fulcrum portion of the horse hook. Via the above arrangement, a function of blocking and restricting the position of the fulcrum portion of a horse hook can be provided, and thus the fulcrum portion of the horse hook cannot be displaced excessively due to an extreme pulling force of the pulling piece. Therefore, the horse hook can be prevented from getting deformed or deviating from a predetermined position.

6 Claims, 4 Drawing Sheets

ZIPPER HEAD

BACKGROUND OF THE INVENTION

1. Field of the Invention

The present invention is related to an improved zipper head, and more particular to an improved zipper head that can restrict the position of a horse hook, have a better structural strength and can be assembled more easily.

2. Description of Related Art

Conventional zipper puller includes a puller, a horse hook, an elastic piece, a cap and a pulling piece. The horse hook is pressed to fit in guiding grooves of the puller via the elastic piece. One end of the pulling piece is positioned under the horse hook. The cap is fixed on the puller and covers above the horse hook and the elastic piece. For example, Taiwan Patent Publication No. M292296 discloses an assembled structure (II) of a zipper head.

However, in the conventional zipper head, the horse hook is pressed to fit in the guiding grooves of the puller via the elastic piece. Since the horse hook can be fixed only by means of the elastic force of the elastic piece, the fulcrum portion of the horse hook may be displaced excessively due to an extreme pulling force of the pulling piece. As a result, the horse hook may get deformed or deviate from a predetermined position.

Consequently, because of the above technical defects, the inventor keeps on carving unflaggingly through wholehearted experience and research to develop the present invention, which can effectively improve the defects described above.

SUMMARY OF THE INVENTION

The object of the present invention is to provide an improved zipper head that can provide a function of blocking and restricting the position of the fulcrum portion of a horse hook, so that the fulcrum portion of the horse hook cannot be displaced excessively due to an extreme pulling force of the pulling piece. Therefore, the horse hook can be prevented from getting deformed or deviating from a predetermined position.

For achieving the object described above, the present invention provides an improved zipper head, which includes: a puller formed with guiding grooves therein, the top of the puller having an accommodating portion and a penetrating hole, the penetrating hole communicating with the guiding grooves; a horse hook having a hook portion and a fulcrum portion, the top surface of the horse hook being formed into an abutting surface, the horse hook being accommodated in the accommodating portion of the puller; a pulling piece having an end portion at one end thereof, the end portion being disposed under the horse hook; an elastic piece, one end thereof being fixed on the puller, the elastic piece abutting against the abutting surface of the horse hook to make the hook portion of the horse hook to penetrate through the penetrating hole of the puller and extend into the guiding grooves; a cap provided with a protrusion on both sides in the interior thereof, the cap covering on the horse hook and the elastic piece, the cap being fixed on the puller, the two protrusions of the cap being located above the fulcrum portion of the horse hook.

The present invention has advantageous effects as follows. The horse hook of the present invention can be fixed via the elastic force of the elastic piece. In addition, two protrusions are provided above the fulcrum portion of the horse hook, thereby providing a function of blocking and restricting the position of the fulcrum portion of the horse hook. Therefore, even when the pulling force of the pulling piece is too large, the fulcrum portion of the horse hook cannot be displaced excessively and thus the horse hook can be prevented from getting deformed or deviating from a predetermined position. Further, the two protrusions are integrally formed on both sides in the interior of the cap. Via this arrangement, the structural strength is good and the assembling process is simple, so that the cost can be reduced efficiently.

In order to further understand the characteristics and technical contents of the present invention, a detailed description is made with reference to the accompanying drawings. However, it should be understood that the drawings are illustrative only but not used to limit the present invention thereto.

DETAILED DESCRIPTION OF THE PREFERRED EMBODIMENTS

Figure 1:
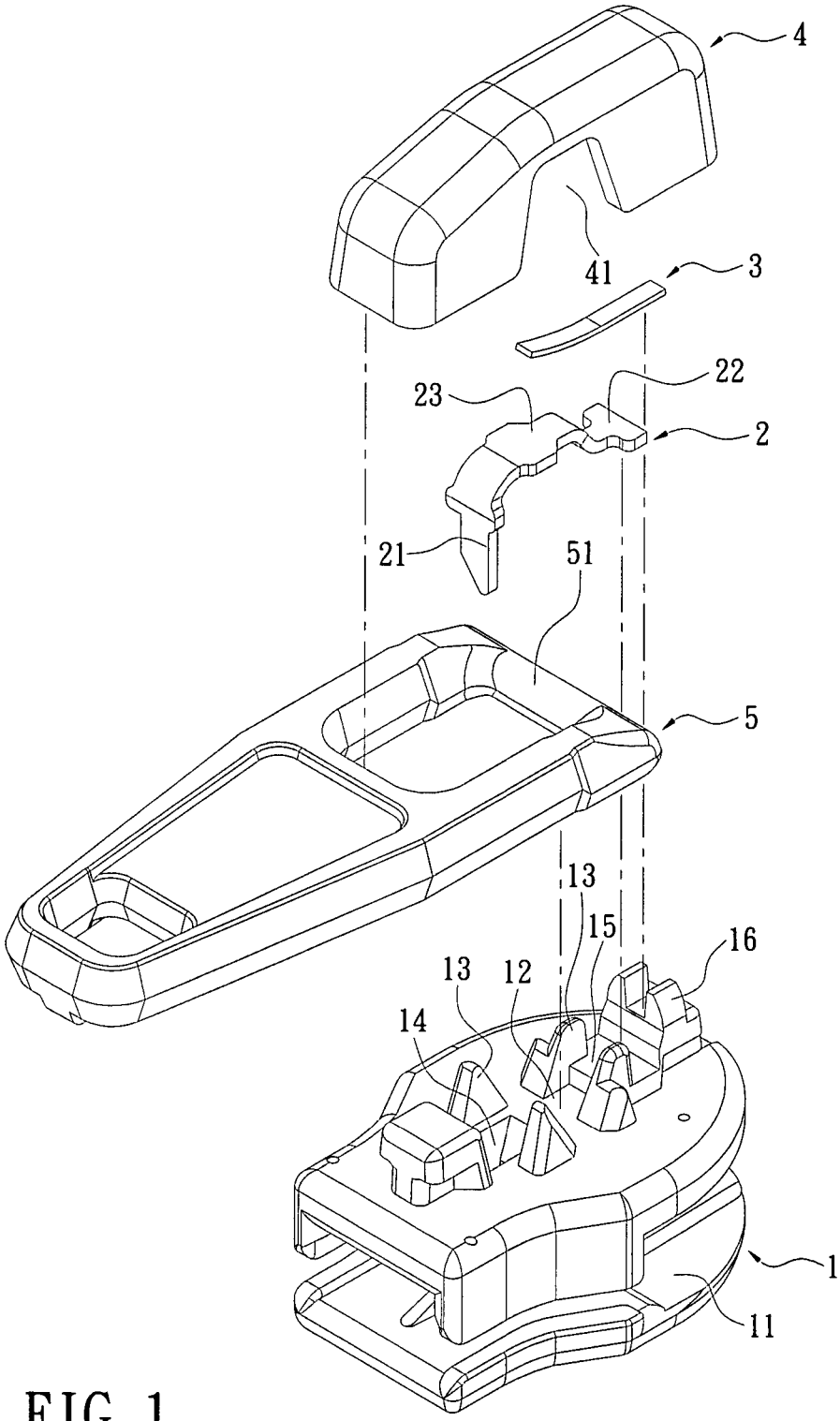
FIG. 1 is an exploded perspective view showing the zipper head of the present invention.
Figure 2:
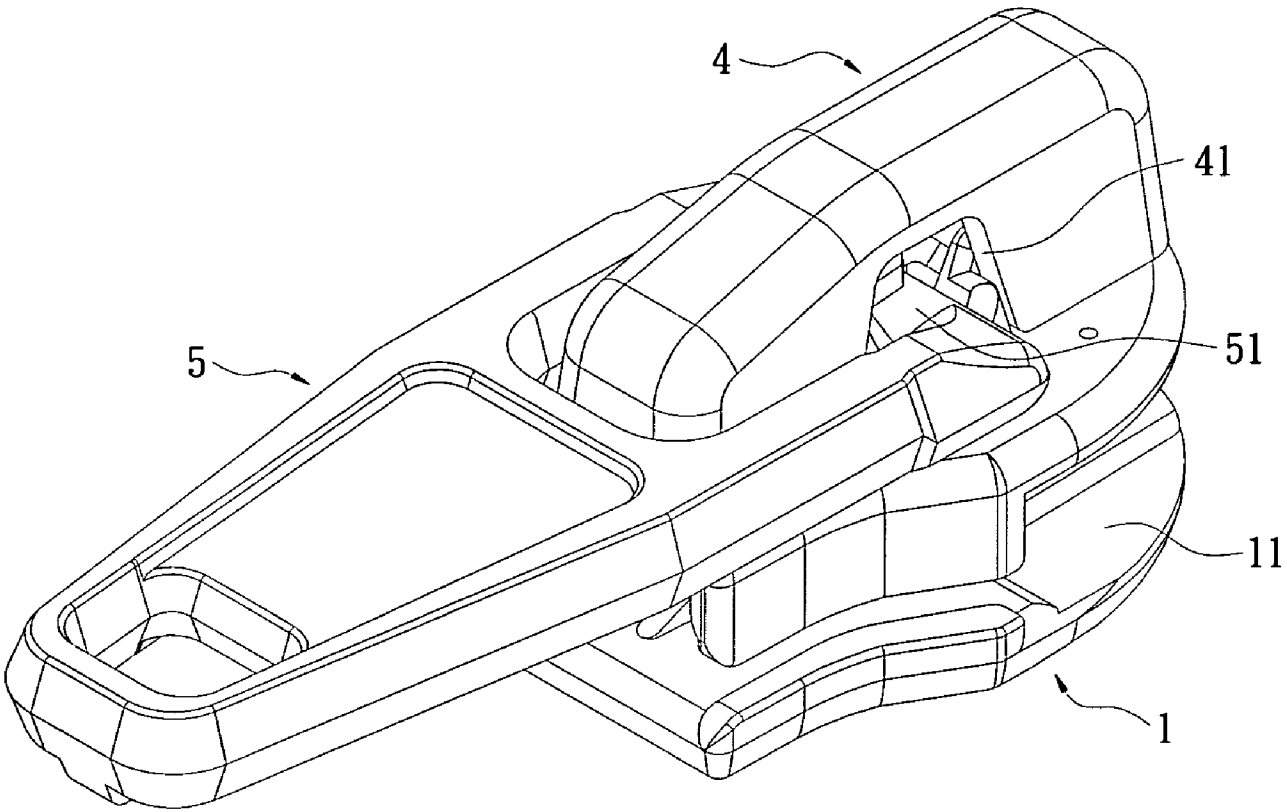
FIG. 2 is a perspective view showing the zipper head of the present invention.
Figure 3:
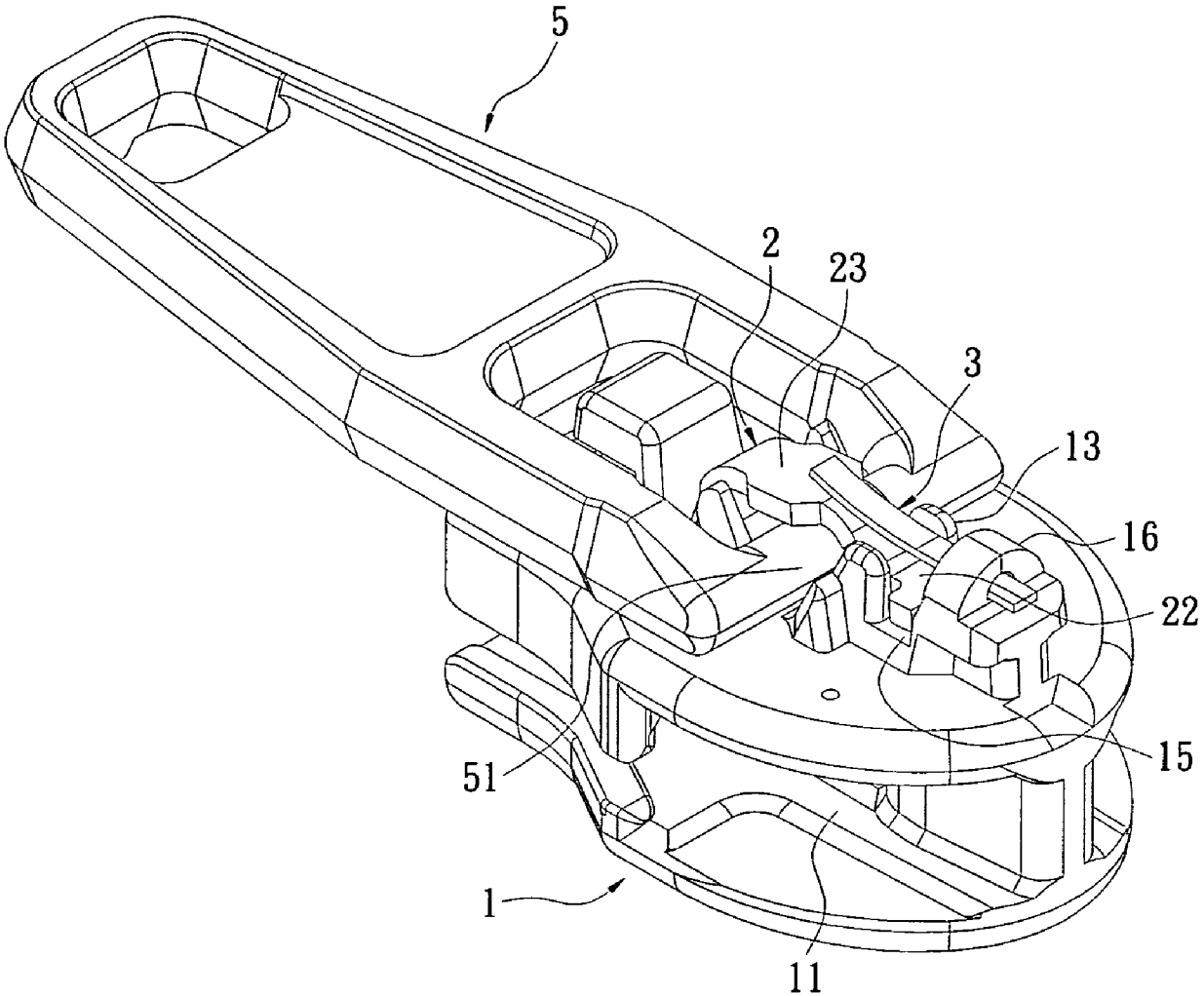
FIG. 3 is a perspective view showing the zipper head of the present invention without a cap.

Please refer to FIGS. 1 to 4. The present invention is to provide an improved zipper head including a puller 1, a horse hook 2, an elastic piece 3, a cap 4 and a pulling piece 5. The interior of the puller 1 is formed with guiding grooves 11 for allowing a zipper (not shown) to be fitted therein. The top of the puller 1 has an accommodating portion 12 for allowing the horse hook 2 to be fitted therein. Both sides of the accommodating portion 12 are provided with a blocking portion 13. Both ends of the accommodating portion 12 are provided with a penetrating hole 14 and a platen 15 respectively. The penetrating hole 14 communicating with the guiding grooves 11. One end of the top of the puller 1 is provided with a fixing base 16.

One end of the horse hook 2 is formed with a hook portion 21, and the other end of the horse hook 2 is formed with a fulcrum portion 22. The top surface of the horse hook 2 is formed with an abutting surface 23 against which the elastic piece 3 abuts. The horse hook 2 is accommodated in the accommodating portion 12 of the puller 1. The blocking portions 13 block both sides of the horse hook 2, thereby preventing the leftward or rightward displacement of the horse hook 2. The hook portion 21 of the horse hook 2 is fitted in the penetrating hole 14. The fulcrum portion 22 of the horse hook 2 is supported on the platen 15. One end of the pulling piece 5 has an end portion 51 that is positioned under the middle section of the horse hook 2.

The elastic piece 3 is made of metallic materials having a better elasticity. The elastic piece 3 has a shape of a sheet body. One end of the elastic piece 3 is fixed on the fixing base 16 of the puller 1. The other end of the elastic piece 3 is formed into a free end and abuts against the abutting surface 23 of the horse hook 2, so that the hook portion 21 of the horse hook 2 can penetrate through the penetrating hole 14 of the puller 1 and extend into the guiding grooves 11, thereby engaging on chain teeth of the zipper. Also, the pulling piece 5 can be pulled to separate the hook portion 21 of the horse hook 2 from the chain teeth of the zipper.

Figure 5:
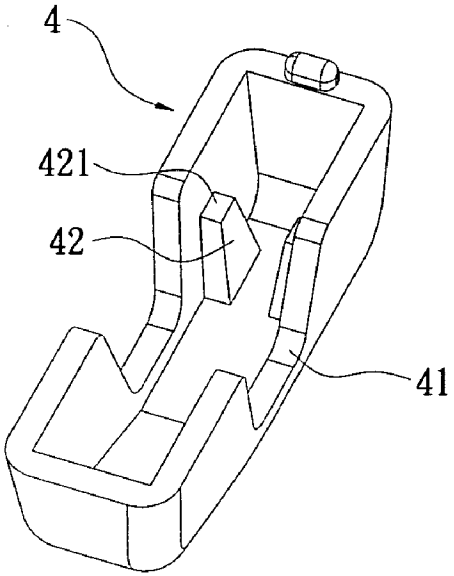
FIG. 5 is a perspective view showing the cap of the present invention.
Figure 4:
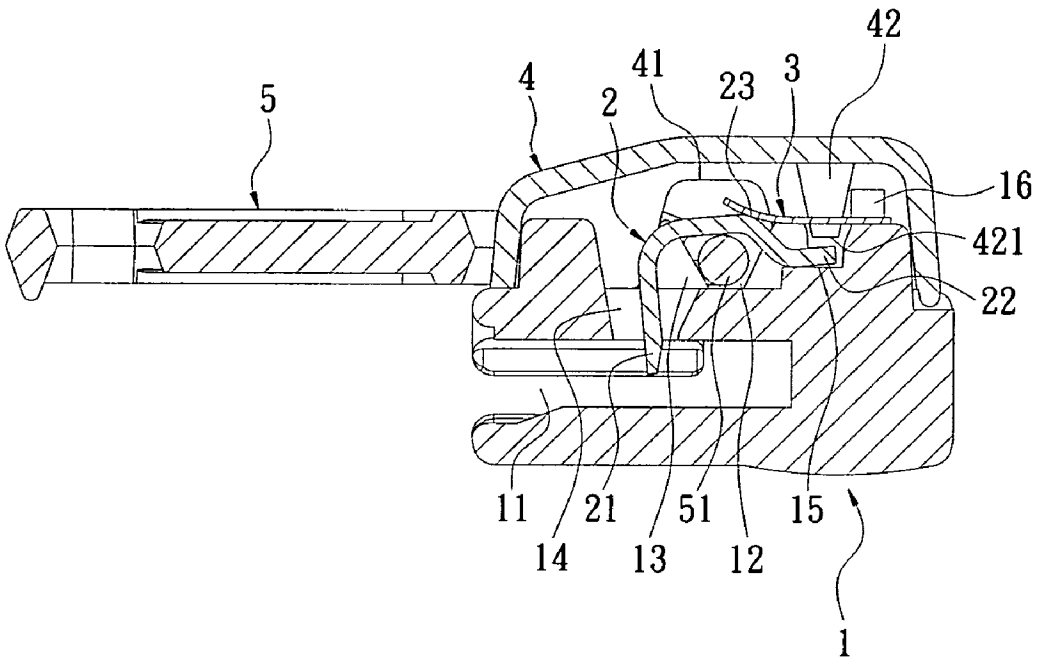
FIG. 4 is a cross-sectional view showing the zipper head of the present invention.

The cap 4 is a hollow cap having an opening on the bottom thereof. Both sides of the cap 4 are formed with a notch 41 respectively (FIGS. 4 and 5). The end portion 51 of the pulling piece 5 penetrates through the two notches 41. A protrusion 42 is provided on both sides within the cap 4. The lower end of each protrusion 42 has a restricting surface 421. The cap 4 covers the top of the puller 1. Further, the cap 4 covers above the horse hook 2 and the elastic piece 3. Both sides of the cap 4 are fixed on the puller 1 via four rivets, thereby combining the puller 1, the horse hook 2 and the elastic piece 3 to form a zipper head. The restricting surfaces 421 of the two protrusions 42 of the cap 4 are located above the fulcrum portion 22 of the horse hook 2, so that the restricting surfaces 421 of the two protrusions 42 can provide a function of restricting the position of the fulcrum portion 22 of the horse hook 2. Via the above construction, the improved zipper head of the present invention can be formed.

In the present invention, the horse hook 2 can be fixed by means of the elastic force of the elastic piece 3. In addition, two protrusions 42 are provided above the fulcrum portion 22 of the horse hook 2, thereby providing a function of blocking and restricting the position of the fulcrum portion 22 of the horse hook 2. Therefore, even when the pulling force of the pulling piece 5 is too large, the fulcrum portion 22 of the horse hook 2 cannot be displaced excessively and thus the horse hook 2 can be prevented from getting deformed or deviating from a predetermined position.

Further, the two protrusions 42 are integrally formed on both sides in the interior of the cap 4. Via this arrangement, the structural strength is good and the assembling process is simple, so that the cost can be reduced efficiently.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A zipper head for operating a zipper fastener having a pair of zipper rows, comprising:

a puller body having guiding grooves for allowing the zipper fastener to be fitted therein, an accommodating portion formed on a top thereof, a fixing base protruded from one end of a top surface thereof, and a penetrating hole permitting passage from the top surface of the puller body to the guiding grooves;

a horse hook having two ends and a middle portion, the horse hook including a hook portion on one end, and a fulcrum portion on the other end, the middle portion formed an abutting surface, the middle portion being accommodated in the accommodating portion of the puller, wherein the hook portion is movably disposed in the penetrating hole of the puller body;

a pulling piece having a pivoting portion disposed in the accommodating portion and under the horse hook;

an elastic piece, being strip-shaped, the elastic piece including a free end and a fixed end fixed on the fixing base of the puller body, wherein the free end of the elastic piece presses against the abutting surface of the horse hook; and a cap having a hollow bottom and two protrusions formed in the hollow bottom portion, the cap covering on the horse hook and the elastic piece, the cap being fixed on the puller, the two protrusions of the cap being located on the fulcrum portion of the horse hook directly.

2. The zipper head according to claim 1, wherein one end of the accommodating portion includes a platen, and the fulcrum portion of the horse hook is fixedly arranged on the platen.

3. The zipper head according to claim 1, wherein each of the two protrusions has a restricting surface, and the restricting surface of the restricting surface is arranged above the fulcrum portion of the horse hook.

4. The zipper head according to claim 1, wherein the puller body further comprises at least two blocking portions on both sides of the accommodating portion, and the horse hook is arranged between the blocking portions.

5. The zipper head according to claim 1, wherein the top of the puller body is provided with a fixing base, and one end of the elastic piece is fixed on the fixing base of the puller.

6. The zipper head according to claim 1, wherein both sides of the cap are formed with a notch and the pivoting portion of the pulling piece penetrates through the notches.

* * * * *